US007621062B2

(12) United States Patent
Cugliari

(10) Patent No.: US 7,621,062 B2
(45) Date of Patent: Nov. 24, 2009

(54) BULLET IDENTIFICATION AND TRACKING DEVICE

(76) Inventor: Gregory Anthony Cugliari, 675 Case Rd., Neshanic Station, NJ (US) 08853

( * ) Notice: Subject to any disclaimer, the term of this patent is extended or adjusted under 35 U.S.C. 154(b) by 396 days.

(21) Appl. No.: 11/087,842

(22) Filed: Mar. 23, 2005

(65) Prior Publication Data

US 2006/0213105 A1 Sep. 28, 2006

(51) Int. Cl.
*F41A 9/53* (2006.01)

(52) U.S. Cl. ..... 42/1.01

(58) Field of Classification Search ..... 42/1.01; 473/570, 578

See application file for complete search history.

(56) References Cited

U.S. PATENT DOCUMENTS

| | | | | | |
|---|---|---|---|---|---|
| 2,661,694 | A | * | 12/1953 | Allen et al. | 102/508 |
| 3,016,969 | A | * | 1/1962 | Devantier | 180/282 |
| 4,035,942 | A | | 7/1977 | Wiczer | |
| 4,175,346 | A | | 11/1979 | Zemsky | |
| 4,253,261 | A | * | 3/1981 | Schmidt | 42/59 |
| 4,664,664 | A | * | 5/1987 | Drake, Jr. | 102/502 |
| 4,858,935 | A | * | 8/1989 | Capson | 473/570 |
| 4,940,245 | A | * | 7/1990 | Bittle, Jr. | 473/570 |
| 5,094,463 | A | * | 3/1992 | Dryden | 473/570 |
| 5,177,318 | A | | 1/1993 | Martinez et al. | |
| 5,446,467 | A | * | 8/1995 | Willett | 342/386 |
| 5,621,998 | A | * | 4/1997 | Norgaard | 42/89 |
| 5,758,446 | A | | 6/1998 | Atchison | |
| 5,953,845 | A | * | 9/1999 | Longwitz | 42/89 |
| 6,041,536 | A | * | 3/2000 | Samuels et al. | 42/70.11 |
| 6,240,849 | B1 | * | 6/2001 | Holler | 102/439 |
| 6,408,556 | B1 | * | 6/2002 | Achee et al. | 42/70.11 |
| 6,450,817 | B1 | * | 9/2002 | Deinlein | 434/11 |
| 6,462,302 | B1 | | 10/2002 | Grow | |
| 6,546,874 | B2 | * | 4/2003 | Vasel et al. | 102/444 |
| 6,604,946 | B2 | * | 8/2003 | Oakes | 434/11 |
| 6,779,716 | B1 | | 8/2004 | Grow | |
| 6,814,678 | B2 | | 11/2004 | Cyr et al. | |
| 6,856,250 | B2 | * | 2/2005 | Hilliard | 340/573.2 |
| 7,300,367 | B1 | * | 11/2007 | Andol et al. | 473/578 |
| 2002/0088367 | A1 | * | 7/2002 | MacAleese et al. | 102/502 |
| 2002/0092223 | A1 | * | 7/2002 | Blomquist et al. | 42/70.11 |
| 2003/0089219 | A1 | * | 5/2003 | Gorman | 89/1.11 |
| 2003/0132846 | A1 | * | 7/2003 | Hilliard | 340/573.2 |
| 2003/0176245 | A1 | * | 9/2003 | Cyr et al. | 473/578 |
| 2004/0099173 | A1 | * | 5/2004 | Rector et al. | 102/501 |
| 2005/0217526 | A1 | * | 10/2005 | Gerardi | 102/351 |
| 2006/0196383 | A1 | * | 9/2006 | Parker et al. | 102/501 |

OTHER PUBLICATIONS http://en.wikipedia.org/wiki/Bullet, taken from Wikipedia, The Free Encyclopedia, on Feb. 28, 2008 (pp. 1-8).
http://en.wikipedia.org/wiki/Arrow, taken from Wikipedia, The Free Encyclopedia, on Feb. 28, 2008 (pp. 1-5).
Wikipedia Encyclopedia, Definition of "Projectile", http://en.wikipedia.org/wiki/Projectile.

* cited by examiner

*Primary Examiner*—Troy Chambers
(74) *Attorney, Agent, or Firm*—Norris, McLaughlin & Marcus

(57) ABSTRACT

An identification and tracking device (110*b*) for use in combination with a firearm bullet (100) comprising a means for detaching the device (110*b*) from the bullet (100) during penetration of the target. In this manner, the tracking device (110*b*) and/or identification device (110*b*) will be attached to an object when the bullet (100) penetrates the object.

14 Claims, 15 Drawing Sheets

BULLET IDENTIFICATION AND TRACKING DEVICE

BACKGROUND

1. Field of Invention

The present invention relates generally to bullets which are capable of being discharged through the muzzle of a firearm. The bullets are generally used for hunting, but can also be used for other reasons including criminal activities. More particularly, the present invention relates to tracking an object hit by the bullet and identifying the individual bullet which was discharged from the firearm.

2. Description of Prior Art

Bullet identification systems have generally consisted of markings on the inside wall of a gun barrel. In this manner, the inventions can place markings on the bullet. If the markings on the bullet are not materially damaged, they can be used to identify the gun that was used to discharge the bullet. The markings on the inside wall of the barrel can result in the barrel deteriorating. Also, debris can build up in the barrel. Also, debris can build up in the additional grooves in the barrel. In addition, many times the bullet passes through the object and the bullet is never recovered, rendering the system ineffective. If the bullet is significantly damaged during penetration, the markings may not be legible, rendering the system ineffective.

DISCLOSURE OF THE INVENTION

According to the present invention there is provided a bullet with a device attached. (A bullet could be a bullet, any firearm projectile, slug, pellet, slug/bullet for a muzzle loader, buckshot, as well as other projectiles propelled from any firearm. A firearm could be any firearm including, but not limited to, rifles, pistols, handguns, shotguns, muzzle loaders, air guns, as well as others.) The device is used to track the location of the object. The device could also be used to identify the individual bullet that was dispensed from the firearm.

Some devices which can be used include passive/active/semi active/semi passive transponders. Foil or Inlay tags can also be used as a device. Many others type of devices can also be used. The device can be of various sizes to accommodate more memory/information to enable the device to be tracked at longer ranges. The device can also have an antenna line attached to enable the device to be tracked at longer ranges. The device can also be a sound device.

My invention could also have a device which is detachably connected to the bullet. The bullet could have means for detaching the device during penetration. In this manner, the device will become attached to the object while the bullet penetrates the object. Even if the bullet travels through the object, the device will remain inside the object.

Accordingly, several objects and advantages of my invention are:

(a) To provide a device which will immediately enable the police to obtain information from a crime scene. The device in the bullet can be a passive transponder that has information which is stored inside the transponder. The passive transponder will be very small and will cost pennies to make and install in the bullet.

An example of how the invention operates is as follows: A person in New York is murdered by a gun and the bullet passes completely through the victim. The bullet cannot be found. The device was detached from the bullet and attached to the victim. A police officer will be able to walk up to the victim and in less than one second, the police officer can obtain valuable information about the bullet. The police officer can immediately obtain:

1. Information about the purchaser of the bullets: The Purchaser's
   a. Name
   b. Social security number
   c. Address
   d. Other important information about the purchaser of the bullets
2. Information about the store where the bullet was purchased. The Store's
   a. Name of the store
   b. Address
   c. Telephone number
   d. Owners name, address, and telephone number
   e. Other important information about the store where the bullet was purchased
3. The date the bullet was purchased
4. Any other information that is considered important Accordingly, even if the bullet was purchased in China, the New York police department could contact the police in China. The Chinese police could be at the house of the person that purchased the bullets 5 minutes after the shooting occurred. In today's environment, the police may never get this level of information. Many crimes go unsolved since there is no valuable evidence obtained.

This invention will minimize the number of firearm crimes because the criminals will know there is an excellent chance they will be caught. It will also put more hardened criminals in jail. This is because if the hardened criminal commits the crime without concerns of the ramification, there is a higher propensity for these criminals to be caught.

Hence, it will be much more difficult to commit a crime with a gun without being caught. Crimes such as sniper shootings, drive by shootings, etc will be substantially reduced. ACCORDINGLY, THE USE OF THIS INVENTION WILL MAKE THE ENTIRE WORLD A SAFER PLACE!

(b) to provide a bullet with a tracking device. When an object is hit, the tracking device will be detached from the bullet and attached to the object.

If this is used in police bullets, the police officer will be able to quickly find a wounded criminal that has fled the crime scene.

If this is used for hunting, the hunter will be able to recover the wounded game quickly, even if the game runs off several hundred yards and has left no tracking signs (i.e., blood trail, and other normal tracking signs).

Further, objects and advantages of my invention will become apparent from consideration of the drawings and ensuing descriptions.

BRIEF DESCRIPTION OF THE DRAWINGS

In the drawings, closely related figures have the same number but different alphabetic suffixes.

REFERENCE NUMERALS IN DRAWINGS

Figure 1:
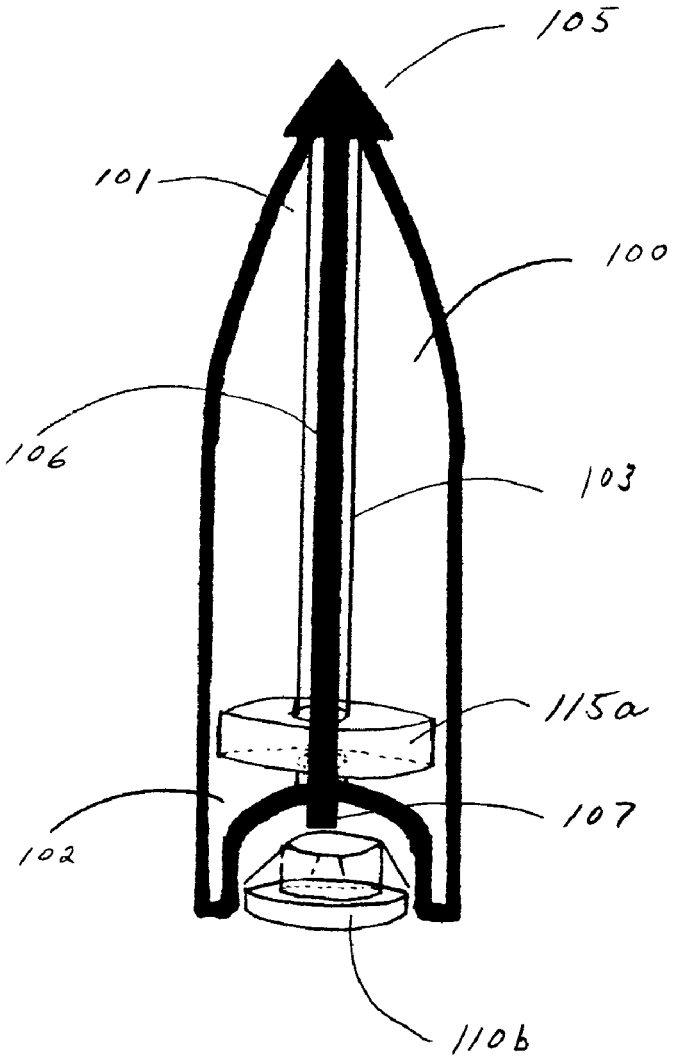
FIG. 1 Is a cut out perspective view of two identification devices installed in a bullet FIG. 1*a* Shows how the embodiment in FIG. 1 will work during penetration FIG. 2 Is a cut out perspective view of one identification device installed in a bullet FIG. 3 Is a perspective view of an identification device prior to installation into a bullet FIG. 4 Is a cut out perspective view of an identification device which is placed outside of the bullet FIG. 5 Is a cut out perspective view of an identification device which is manufactured inside the metal of the bullet FIG. 6 Is a cut out perspective view of a foil or inlay tab identification device which is manufactured inside the metal of the bullet FIG. 7 Is a cut out perspective view of an identification device which is attached to the bullet and the device is not detachable from the bullet FIG. 8 Is a cut out perspective view of an identification device placed on the outside of the bullet and the device could stay affixed or could detach from the bullet FIG. 9 Is a cut out perspective view of an identification device placed on the outside of the bullet FIG. 10 Is a cut out perspective view of an identification device with a different attaching system FIG. 11 Is a cut out perspective view of an identification device with an attaching system with a different attachment clip FIG. 12 Is a cut out prospective view of a bullet with a trigger tip extended out from the bullet FIG. 13 Is a cut out prospective view of a bullet with a trigger tip which starts inside the bullet FIG. 14 Is a cut out prospective view of a bullet used in a handgun with a trigger tip which starts inside the bullet

100 Bullet
101 Bullet tip
102 Bullet tail end
103 Bullet aperture
105 Trigger tip
106 Trigger shaft
107 Trigger tail end
110*a* Donut shaped device
110*b* Barbed detaching device
110*c* Detaching external device
111 Barbs
115 Embedded device
115*a* Embedded device with aperture
115*b* Embedded foil device
120 Non-detaching device
125 External device
130 External attaching device
131 Rigid arms
135 Extension line
140 Detaching clip
140*a* Barbed detaching clip

DETAILED DESCRIPTION OF PREFERRED EMBODIMENT

Referring now to the drawings, wherein like reference numerals designate identical or corresponding parts throughout the several views, FIG. 1 shows a bullet (100) with two identification devices attached. The bullet (100) has an aperture (103) which runs through the center of the bullet from the bullet tip (101) at the proximal end of the bullet to the bullet tail end (102) at the distal end of the bullet. The aperture (103) is of sufficient width to house the trigger shaft (106). The trigger tip (105) is connected to the trigger shaft (106). The trigger shaft (106) transverses the center of the bullet (100) from the bullet tip (101) to the bullet tail end (102). A barbed detaching device (110*b*) is pressure fitted into a hollow bullet tail end (102). Stated another way, the device is detachably affixed in an aperture at the distal end of the bullet. Another device, an embedded device (115*a*) is permanently embedded inside the metal of the bullet (100). Upon penetration of the bullet (100), the trigger tip (105) will be pushed into the body of the bullet (100). The trigger shaft (106) will slide inside the bullet aperture (103) in the direction of the bullet tail end (102). The trigger tail end (107) will begin to push the barbed detaching device (110*b*) out of the hollow end of the bullet tail end (102). The barbed detaching device (110*b*) will be pushed out of the bullet (100) at a predetermined approximate depth of penetration. If the bullet (100) penetrates an object and passes through the object, the barbed detaching device (110*b*) will remain inside the object. Accordingly, if the barbed detaching device (110*b*) is a passive transponder, information about the bullet (bullet owner, firearm type, seller of the bullet, etc.) will be immediately available to the police.

If the bullet does not pass through the object, a second identification device, the embedded device (115*a*), will be in the object and may also be used to gather information.

The embedded device (115*a*) will almost entirely eliminate the possibility of the identification device being tampered with by a person with a criminal intent. If a sophisticated criminal had the ability and desire, the sophisticated criminal could disarm the barbed detaching device (110*b*) by taking the bullet out of the bullet shell and removing the barbed detaching device (110*b*). But the criminal could not remove the embedded device without destroying the bullet and hence rendering the bullet unshootable. Accordingly, bullet tampering will be minimized or eliminated with the use of an embedded device. The device should also be made with sufficient weight and density so that even if the device is detached from the bullet (100) prior to penetration, the device will penetrate the object.

Figure 1A:
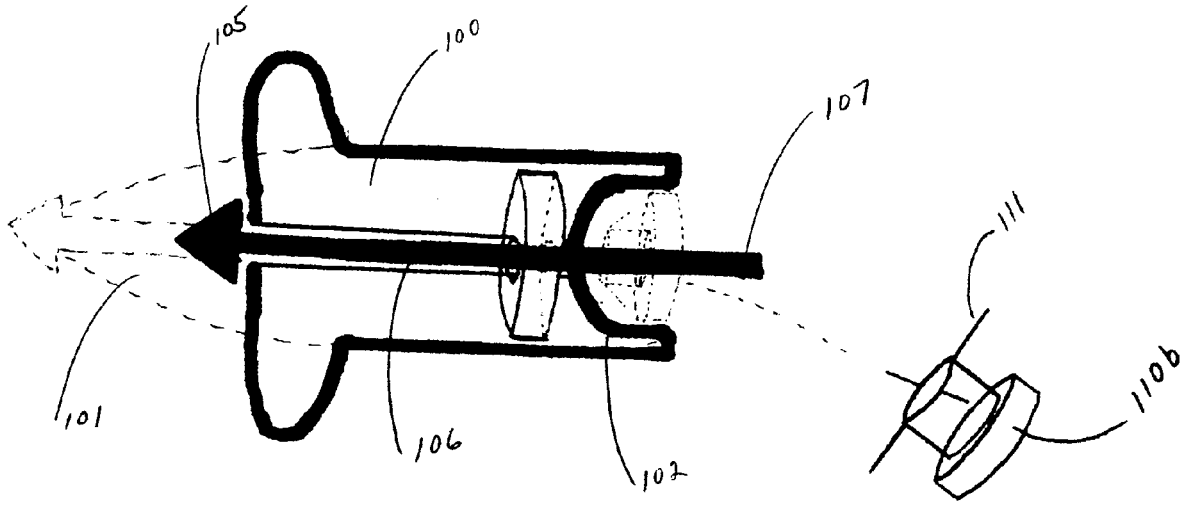

FIG. 1*a* shows a bullet (100) during penetration. During penetration, the trigger tip (105) will be pushed back causing the bullet tip (101) to compress/mushroom. As the trigger tip (105) is pushed back, the trigger shaft (106) will slide back. The trigger tail end (107) will be moving backward, pushing the barbed detaching device (110*b*) out of the hollow bullet tail end (102). In this manner, the barbed detaching device (110*b*) will be pushed out of the bullet (100) during penetration. The trigger shaft (106) could be made in different lengths. If the trigger shaft (106) is shortened, the device will be detached from the bullet (100) deeper during penetration. Conversely, a longer trigger shaft (106) will detach the device earlier during penetration. Accordingly, the device can be released at a predetermined estimated depth range. As an example, the bullet (100) could be set up to detach the device between 3 to 5 inches into penetration. In this manner, if the bullet (100) hits bone on the entry, the device will not detach until the bullet enters the object by at least 3 inches. Also, the device can be made with sufficient weight and density. In this manner, if the device is detached before the device enters the object, the device will have sufficient speed and weight to penetrate the object. In a study conducted by Belkin in 1978, the speed at which a projectile must travel to penetrate skin is 163 feet per second and to break bone is 213 feet per second, both of which are quite low. Even the weaker handguns cast bullets at speeds of 1,000 feet per second and greater. The detached device will always have sufficient speed and energy to enable it to penetrate the object by itself, even if the device is inadvertently detached from the bullet prematurely during penetration.

The trigger shaft (106) can also be used to activate a device. The device does not have to detach from the bullet. The trigger shaft (106) could slide back and push a lever, push a button, etc. The device could also house a battery, and as such it would be preferable to activate the device upon penetration. This would avoid the possibility of the battery dying.

Figure 2:
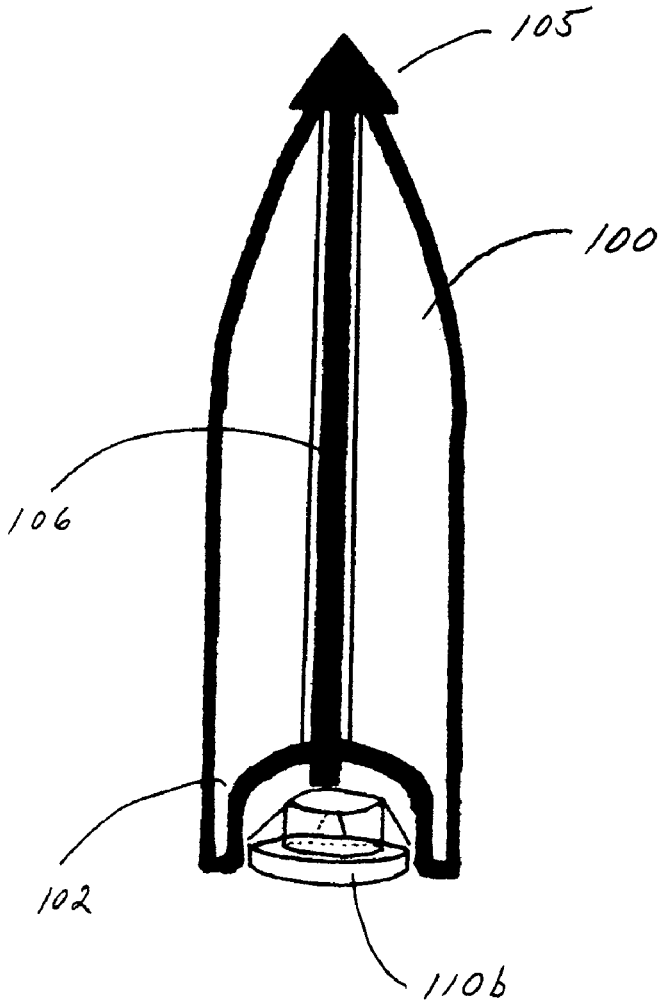

FIG. 2 shows a bullet (100) with one device attached. This embodiment is the same as the embodiment presented in FIG. 1 except that the embedded device (115*a*) of FIG. 1 is not included in this embodiment. Accordingly, upon penetration of the bullet (100) the trigger shaft (106) will slide in the direction of the bullet tail end (102) and will push the barbed detaching device (110*b*) out of the bullet (100). This embodiment could be used in tracking devices where bullet tampering is not a concern.

Figure 3:
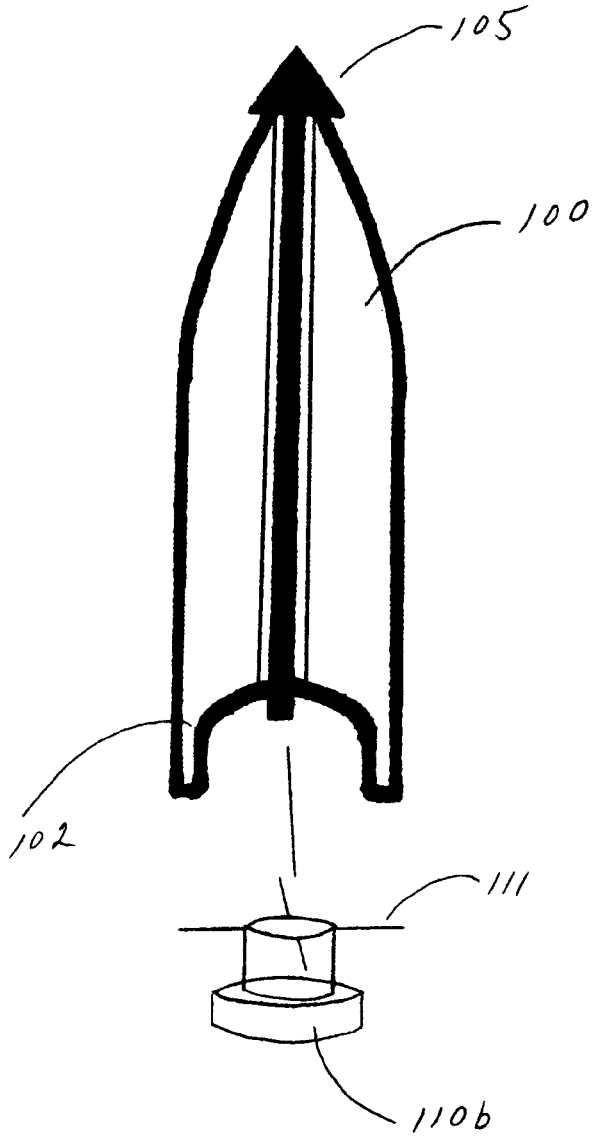

FIG. 3 shows a bullet (100) with the barbed detaching device (110*b*) prior to insertion into the hollow bullet tail end (102). The barbs (111) or arms of the barbed detaching device (110*b*) are in their extended position. When the barbed detaching device (110*b*) is pushed out of bullet (100) during penetration, the barbs (111) will extend outward and catch/attach to the interior of the object being penetrated. In this manner, the barbed detaching device (110*b*) will stay in the interior of the object penetrated.

Figure 4:
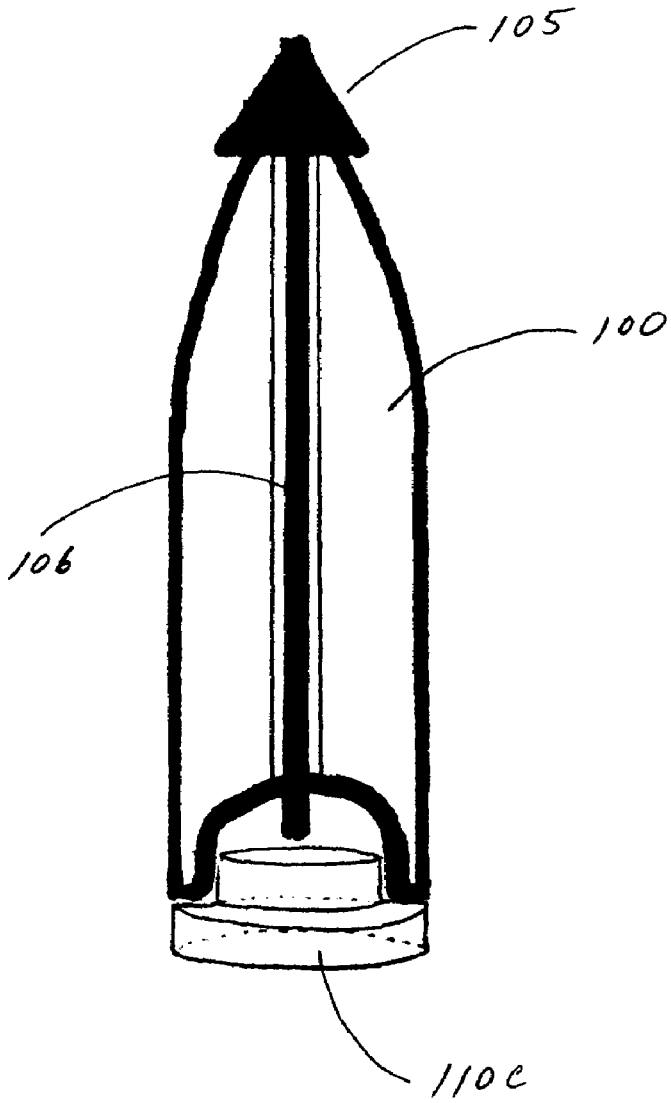

FIG. 4 shows a bullet (100) with a detaching exterior device (110*c*). The detaching exterior device (110*c*) is positioned substantially on the exterior of the bullet (100). Whereby, upon penetration of the bullet (100), the trigger shaft (106) will slide back and push the detaching exterior device (110*c*) away from the bullet (100) and the detaching exterior device (110*c*) will detach from the bullet (100).

Figure 5:
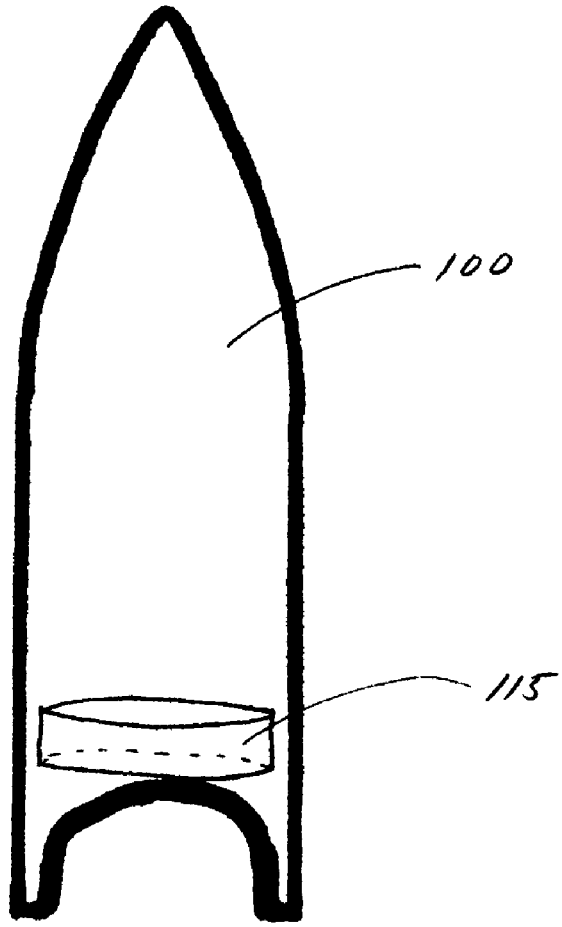

FIG. 5 shows a bullet (100) with an embedded device (115). The embedded device (115) is in the solid interior of the bullet (100). The embedded device (115) is placed in the interior of the bullet (100) during the manufacturing process of the bullet (100). The embedded device (115) is completely enveloped in the solid metal core of the bullet (100).

Figure 6:
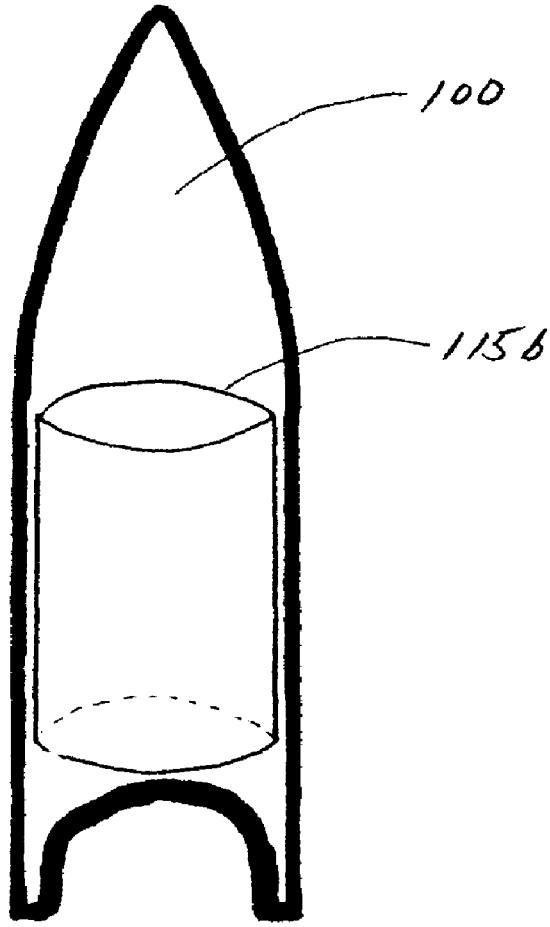

FIG. 6 shows a bullet (100) with an embedded foil device (115*b*). The embedded foil device (115*b*) is a label like material containing a device. Since the device is a thin material, it can be wrapped around the bullet (100) during the manufacturing process of the bullet (100). Additional metals or other materials can be placed over the embedded foil device (115*b*) protecting it from the barrel of the gun when the bullet (100) is shot. The additional metals will also protect the embedded foil device from tampering.

Figure 7:
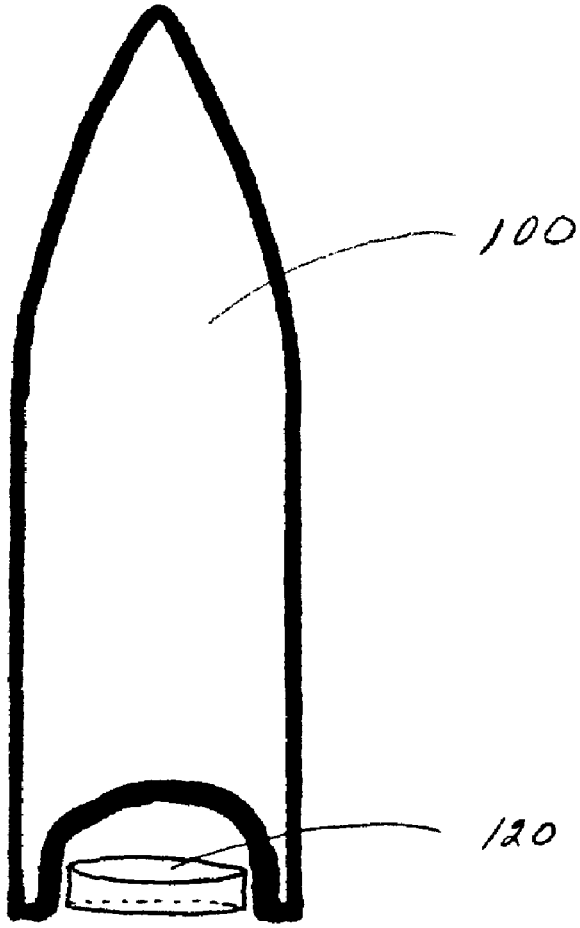

FIG. 7 shows a bullet (100) with a non-detaching device (120) positioned in the hollow interior of the bullet (100). In this manner, the device will not detach from the bullet (100). If the bullet (100) is found, the device can be accessed.

Figure 8:
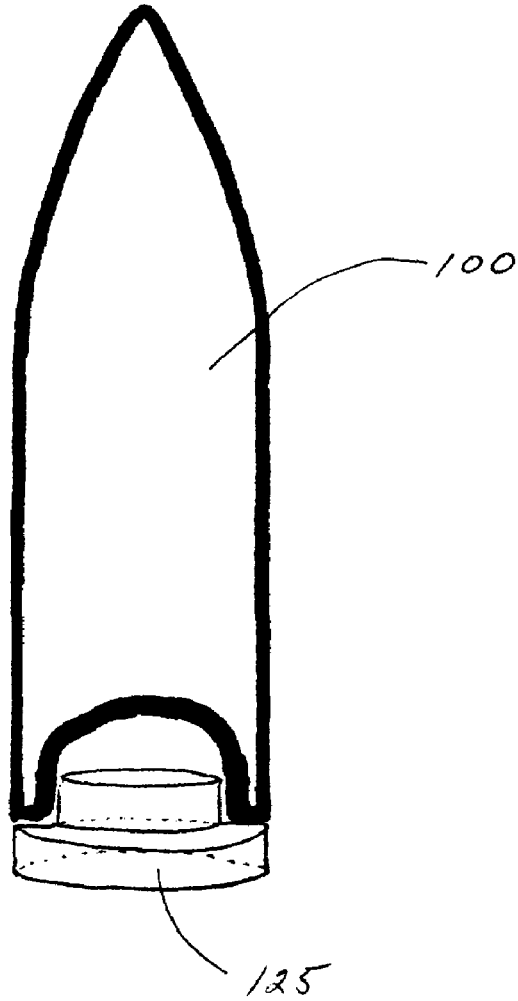

FIG. 8 shows a bullet (100) with an external device (125). The external device (125) is positioned substantially to the exterior of the bullet at the distal end of the bullet. In this manner, either the external device may stay with the bullet (100) during penetration or it could be detachably affixed to the distal end of the bullet and detach during penetration. Some bullets (100) use sabots on the exterior of the bullet (100). The sabot sometimes detaches from the bullet (100) shortly after the bullet (100) leaves the muzzle of the gun and other sabots stay with the bullet (100) during flight and penetration of the object. The sabot, which stays with the bullet (100) during flight and penetration of the object is considered part of the bullet because it performs the same function as the bullet. In the cases where the sabot is part of the bullet (100) and stays with the bullet (100) during flight and penetration of the bullet (100), the device could be attached directly to the sabot similar to the external device (125) of FIG. 8 or the non-detaching device (120) of FIG. 7. The sabot acts as an additional layer of the bullet (100). Since certain sabots are designed to detach from the bullet (100) during penetration, a device could be attached to the sabot and as such, be released from the bullet (100) into the object during penetration. In this manner, the sabot itself can be used as an activating means for the device.

Figure 9:
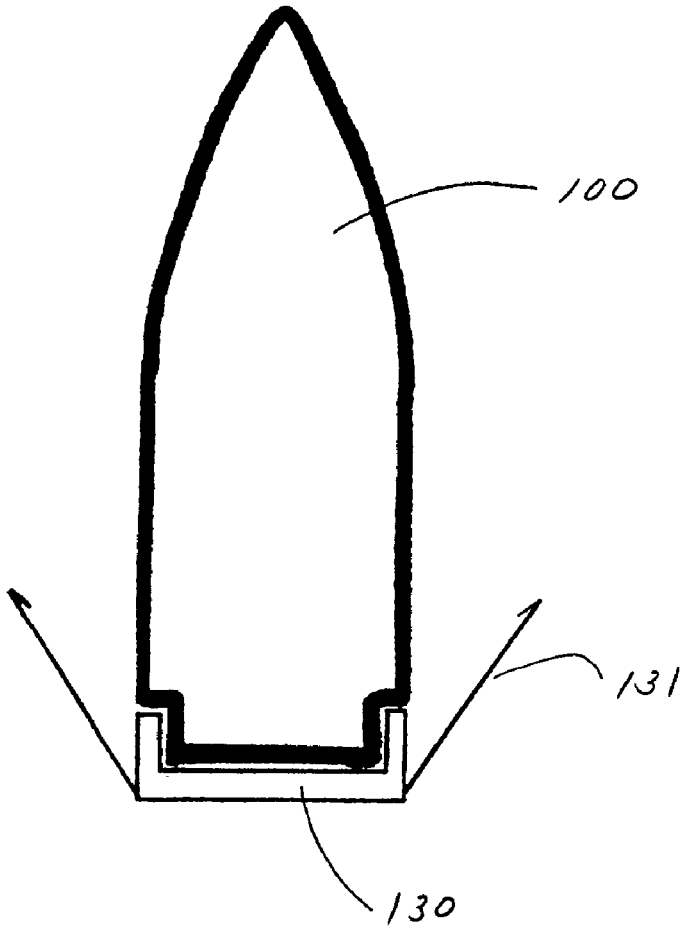

FIG. 9 shows a bullet (100) with an external attaching device (130). The external attaching device (130) has rigid arms (131) which affix to the object being penetrated. The external attaching device (130) is detachably affixed at the distal end of the bullet (100). In this manner, the external attaching device (130) will detach from the bullet (100) when the bullet (100) penetrates the object. The rigid arms (131) will affix to the object which is being penetrated.

In order the avoid damage to the rigid arms (131) when the bullet (100) is shot, the bullet (100) could have cut out grooves on its side to house the rigid arms (131) when the bullet (100) is traveling through the barrel of the gun. Another way the rigid arms (131) can be protected as the bullet (100) travels through the barrel of the gun is by a sabot. The sabot will encompass the exterior of the bullet during its travel through the barrel and the sabot will detach from the bullet (100) when the bullet (100) leaves the barrel. In this manner the sabot will protect the rigid arms (131).

Figure 10:
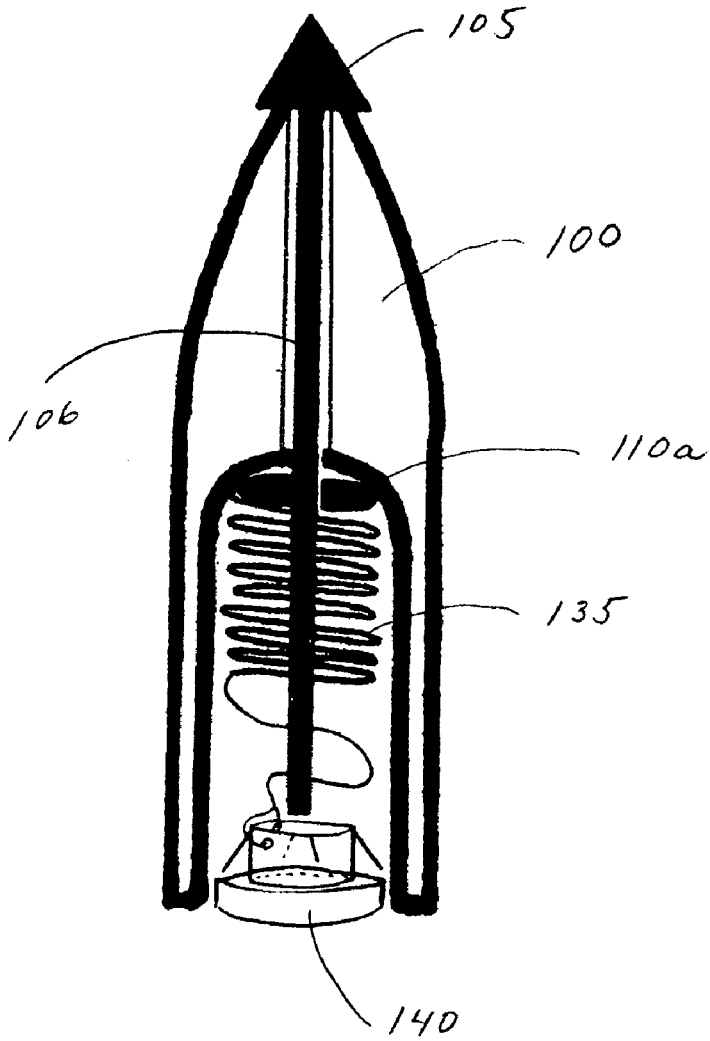

FIG. 10 shows a bullet (100) with a detaching clip (140). The detaching clip (140) can be distinguished from the barbed detaching device (110*b*) of FIG. 1 in that there is no device which is housed in the detaching clip (140). The detaching clip (140) is connected to one end of an extension line (135) and the other end of the extension line (135) is connected to a donut shaped device (110*a*). Whereby, when the bullet (100) penetrates the object, the trigger shaft (106) pushes the detaching clip (140) out of the bullet (100). The detaching clip (140) then pulls the extension line (135) and the extension line (135) pulls the donut shaped device (110*a*). Accordingly, the device will be pulled out of the bullet (100) during penetration by the extension line (135). This embodiment could have several advantages over other embodiments discussed herein. Some advantages are:

1. The extension line could be of a material that could be used as an antenna for the device.
2. Since there is a length between the detaching clip (140) and the donut shaped device (110*a*), the detaching clip (140) could be detached anywhere before entrance to the object or while in the interior of the object and the device wills stay with the object.
3. The extension line (135) could be of a sufficient length to enable the donut shaped device (110*a*) to be located on the exterior of the exit side of the object while the detaching clip remains on the inside of the object. In this manner the device could get better reception since it is exposed to the exterior of the object.

Figure 11:
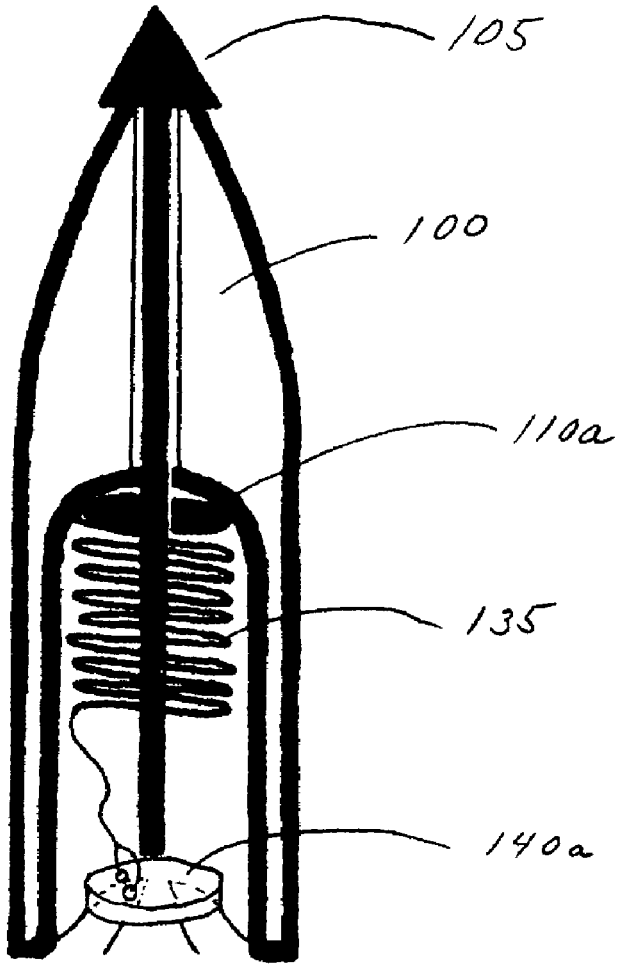

FIG. 11 shows the same embodiment as FIG. 10 except that the detaching clip (140) of FIG. 10 is replaced with a barbed detaching clip (140*a*). the barbs on the barbed detaching clip (140*a*) hold the barbed detaching clip (140*a*) in place in the bullet (100). The barbs on the barbed detaching clip (140*a*) also assist the barbed detaching clip (140*a*) in affixing to the interior of the object being penetrated.

Figure 12:
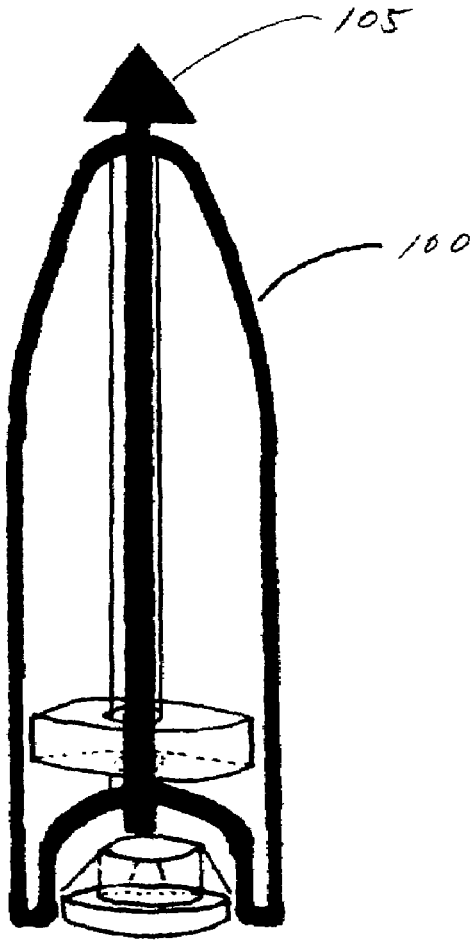

FIG. 12 shows the same embodiment as FIG. 1 except that the trigger tip (105) is extended forward. In this manner, the device will be detached from the bullet (100) much quicker. The rapid detaching of the device may be useful with tracking devices used on thin skinned animals, as well as for other reasons.

Figure 13:
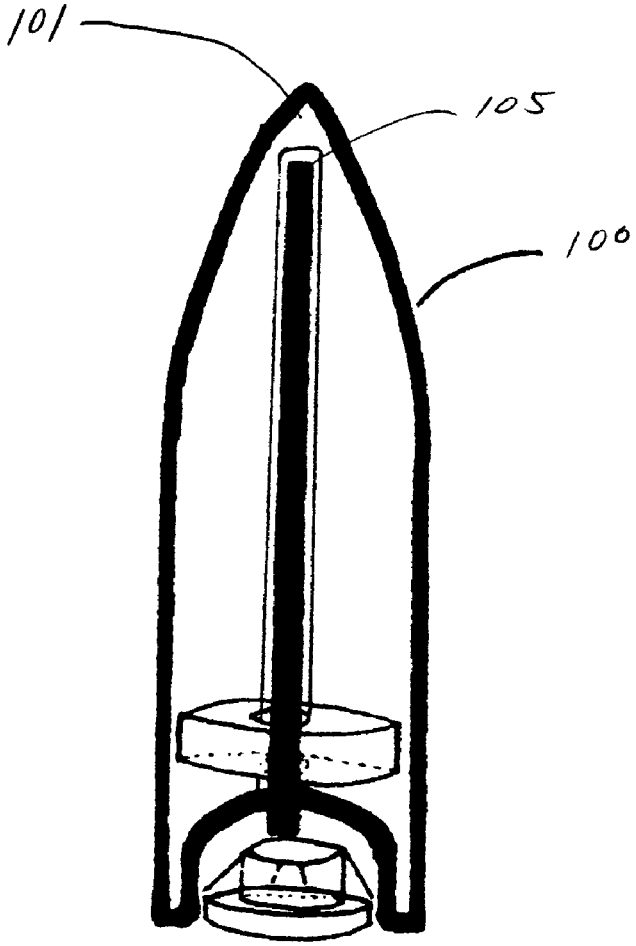

FIG. 13 shows the same embodiment as FIG. 1 except that the trigger tip (105) is positioned inside the body of the bullet. This will enable bullet manufacturers to continue to manufacture all the current style of bullets which they currently produce. Also, depending on the depth of the trigger tip (105) in the bullet tip (101), the device can be detached at various penetration depths.

Figure 14:
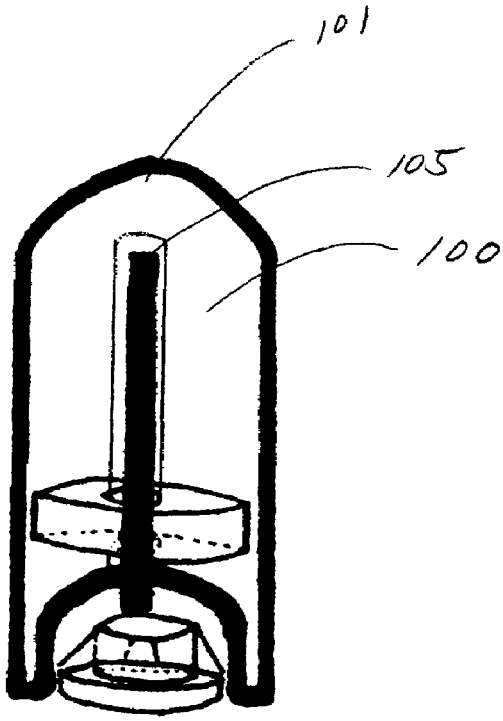

FIG. 14 shows the same embodiment as FIG. 1 except the bullet is a handgun bullet. The trigger tip (105) is positioned a substantial distance from the bullet tip. In this manner, the device will detach deeper within the object. If the trigger tip (105) is positioned closer to the surface of the bullet tip (101), the device will detach sooner.

From the descriptions above, a number of advantages of my bullet identification and tracking device become evident:

(a) The police will be able to obtain valuable evidence in a crime immediately upon arriving at the crime scene.

(b) The identification device will be easy to install and the cost of the identification device will be very small, probably much less than ten cents per bullet.

(c) If the device is a transponder, significant information can be stored in the device.

(d) The device can be used for tracking objects which have been hit with the bullet.

(e) In the preferred embodiment, there are no exposed parts of the device.

(f) The bullet flight is not affected by the attached device because the device is held on the interior of the bullet.

(g) The antenna line will enable the device to be accessed from further distances away.

(h) The device can be detached at a predetermined range of penetration depth.

My device can even be used in a shotgun shell where the pellets may be too small to house a device. The device could be embedded in the wad of the shotgun shell and additional devices could be placed in with the pellet of the shotgun shell. The device does not have to be the same size or density as the pellets. So, as an example, a birdshot shotgun shell could have an identification device in the wad of the shotgun shell. The shotgun shell could have one identification device in the wad of the shotgun shell and the shotgun shell could also have one, two or more identification devices commingled in with the pellets of the shotgun shell. The devices could be made with sufficient weight and density to penetrate an object. The device could also be light enough to avoid penetration, if that is the desired outcome. In this manner, the device which is not connected to the bullet can be used as identification device, tracking device, etc.

A device which is not connected to the bullet can also be used in rifle shells, slug shells, etc. This could be used in addition to the device attached to the bullet. This will result in more evidence being disbursed in a crime scene regardless of what firearm type is used in the crime. The device can be used in all types of firearms. The device can even be used in a muzzleloader where there is no bullet shell. In this situation, the device could be part of the other items that are placed in the muzzle prior to shooting the muzzleloader.

The device could also be attached to the bullet shell. In this case, prior to firing, the device can be used to identify the owner. If an unfired bullet shell is found at the scene of the crime, the information can still be obtained. If the firearm is found with the unfired bullet shells in the gun, the information can still be obtained. If the device is made as part of the bullet shell itself, the information can be accessed from the shell whether the bullet has been fired or if it unfired. In this case, the bullet shell could be made with a foil device wrapped around the bullet shell. Also, an embedded device could be placed on the bottom of the bullet shell. The device used in a bullet shell could be an identification device, a sound device or another type of device. As a sound device, the device could beep when the bullet shell is located to far from the gun. In this manner, if the bullets are stolen, the bullets will beep because the gun for which the bullets were purchased is not within a reasonable distance of the bullets. Accordingly, any device which is used in combination with either a bullet or a bullet shell has been considered in this invention. In the case of a muzzle loader, the device can be a separate item not connected to the bullet and not included in a bullet shell. Since the muzzle loader does not have a bullet shell, the device will be placed in the barrel along with the other items which are placed in the barrel. Accordingly, this invention can be used without a bullet shell, without the bullet being fired, and without the device being connected to the bullet. For the purpose of this invention, the bullet shell is defined to include a barrel of a firearm for which no bullet shell is used. As an example, a muzzle loader rifle does not use a bullet shell. In this case, the barrel of the muzzle loader is deemed to act as a bullet shell.

While my above description contains much specificity, these should not be construed as limitations on the scope of the invention, but rather as an exemplification of one preferred embodiment thereof. Many other variations are possible. Some examples of other variations have been explained above.

Thus, the scope of the invention should be determined not by the embodiments illustrated, but by the appended claims and their legal equivalents.

I claim:

1. A bullet capable of being discharged through the muzzle of a firearm, the bullet comprising a tip, a tail end, a tracking and/or identification device detachably affixed at the tail end and means for detaching said tracking and/or identification device from the bullet after impact of the bullet with a target, whereby, the tracking and/or identification device has functionality after detaching from the bullet.

2. The bullet of claim 1 wherein said detaching means detaches the tracking and/or identification device in the interior of the target which has been impacted.

3. The bullet of claim 1 wherein the tracking and/or identification device is exposed to the exterior of the side of the bullet and the tracking and/or identification device is detached by friction of the target against the bullet during penetration of the bullet into the target after impact.

4. The bullet of claim 1 wherein the detaching means comprises a shaft which transverses an aperture in an interior of the bullet which extends from a vicinity of the bullet tip in a direction of the bullet tail, the tracking and/or identification device is arranged more rearward in the bullet than the shaft; whereby, when the bullet impacts the target, the bullet compresses in a longitudinal direction causing the shaft to slide through the aperture, causing the tracking and/or identification device to detach from the bullet.

5. The bullet of claim 1 wherein the tracking and/or identification device comprises an information device which stores information that can identity the bullet, the gun, and/or the shooter or provide other desired information.

6. The bullet of claim 1 wherein the tracking and/or identification device is selected from the group consisting of transponders, transmitters, spool of line, sound devices, and GPS devices.

7. The bullet of claim 1 wherein the tracking and/or identification device comprises means which attach to the target whereby after the bullet impacts the target the tracking and/or identification device detaches from the bullet and attaches to the target.

8. The bullet of claim 1 wherein the tracking and/or identification device has activation means activated by the detaching means which activates the tracking and/or identification device when the bullet impacts the target, whereby, the tracking and/or identification device is dormant until the tracking and/or identification device is detached from the bullet.

9. The bullet of claim 1 wherein a second tracking and/or identification device is encased in the interior of the bullet.

10. The bullet of claim 1 wherein the tracking and/or identification device is a transponder.

11. The bullet of claim 1 wherein the tracking and/or identification device is a transmitter.

12. The bullet of claim 1 wherein the tracking and/or identification device is detachable at a predetermined point after impact.

13. The bullet of claim 1 wherein the tracking and/or identification device is located in the interior of the bullet.

14. The bullet of claim 1 further comprising at least one additional tracking and/or identification device attached to components of a bullet shell other than the bullet.

* * * * *